US005749438A

United States Patent [19]

Rothkirch

[11] Patent Number: 5,749,438

[45] Date of Patent: May 12, 1998

[54] SAFETY DEVICE FOR EMERGENCY EXITS

[76] Inventor: Horst Rothkirch, Rietschelstrasse 4, D-01069, Dresden, Germany

[21] Appl. No.: 578,666

[22] PCT Filed: Jul. 18, 1994

[86] PCT No.: PCT/DE94/00824

§ 371 Date: Jan. 19, 1996

§ 102(e) Date: Jan. 19, 1996

[87] PCT Pub. No.: WO95/03091

PCT Pub. Date: Feb. 2, 1995

[30] Foreign Application Priority Data

Jul. 19, 1993 [DE] Germany ..... 43 24 196.4

[51] Int. Cl.[6] ..... A62B 5/00

[52] U.S. Cl. ..... 182/138; 182/45

[58] Field of Search ..... 182/45, 138, 82

[56] References Cited

U.S. PATENT DOCUMENTS

| | | | |
|---|---|---|---|
| 4,074,791 | 2/1978 | Inman | 182/138 |
| 4,090,585 | 5/1978 | Laub . | |
| 5,083,636 | 1/1992 | Goldenberg | 182/138 |

FOREIGN PATENT DOCUMENTS

| | | | |
|---|---|---|---|
| 2049358 | 3/1971 | France . | |
| 2429882 | 1/1980 | France . | |
| 11035 | 2/1880 | Germany . | |
| 1534949 | 8/1969 | Germany . | |
| 2199069 | 6/1988 | United Kingdom | 182/45 |
| 14068 | 9/1991 | WIPO . | |
| 9114068 | 9/1991 | WIPO . | |

*Primary Examiner*—Alvin C Chin-Shue
*Attorney, Agent, or Firm*—Jordan and Hamburg

[57] ABSTRACT

The invention relates to a safety device for emergency exits in vertical or oblique surfaces of buildings. The safety device essentially consists of a safety bracket (4) which, extends over the emergency exit in such a way that in the inoperative position its transverse rod (10) and the shanks (9) respectively lie beneath and beside the emergency exit. The safety bracket (4) is pivoted on the building. In an emergency, the safety bracket (4) is raised and stably supported in the safety position by two supports (12). Between the safety bracket (4) and the building there is a safety net (17) surrounding the emergency platform (5). People involved in an emergency can, in an initial stage, place themselves on the emergency platform (5) in the open air, in a safe position, from which they can escape or be rescued.

12 Claims, 3 Drawing Sheets

SAFETY DEVICE FOR EMERGENCY EXITS

BACKGROUND OF THE INVENTION

The invention relates to a safety device for emergency exits in vertical or oblique surfaces of buildings.

Emergency exits in the outer facade of buildings are usually required only if there are no escape routes within the building, in complying with safety regulations. This is frequently the case when buildings are renovated or expanded subsequently and it is not possible to adhere to the safety regulations in the interior of the building. For example, it may be intended to build useable rooms in existing attics, although there is only a narrow access to the rooms within the building. If the safety regulations require a second escape route in such cases, the only possibility available is to use the windows as an emergency exit. In such cases, it is generally necessary to mount unattractive and visually or functionally annoying emergency exits and stairways with expensive banisters on the outer facade of the building. Such solutions are justifiable if the respective outer facade of the buildings faces, for example, rear yards or other shielded sides. It is the general opinion that such permanently installed emergency exits are not justifiable in public places in towns or cities. In particular, such emergency exits are prohibited on buildings of historical value by organization responsible for protecting historical monuments. Consequently, the intended roof expansions cannot be realized or unjustifiable expenditures arise in connection with providing within the building a second escape route.

Different emergency exits are already known for vertical surfaces of buildings. They are mounted below windows in the wall, lying against it in an inoperative position. In an emergency, the respective balcony-like emergency exit is swiveled into a horizontal position utilizing gravity. In this position, it is held from above by means of chains or the like.

In the DR 11035, a platform is described which can be let down and rotated and is mounted in the facade of a building in front of a window. On either side of the window frame, the platform has framework rods, the lower ends of which are mounted in the facade so that they can rotate. At their upper ends, the framework rods are connected with a crossbar. In an emergency, the platform can be brought into the horizontal position and held in this position from above by a chain. Iron slats, nets or the like between the framework rods serve as a surface on which the persons to be rescued can stand.

U.S. Pat. No. 4,090,585 describes a balcony-like exit from a window, which consists of sturdy bottom and railing parts. In the inoperative position, the emergency exit is folded together and, with a bottom part which is mounted rotatably at the building, folded upward against the vertical surface of the building. In an emergency, the emergency exit, utilizing the force of gravity, is swiveled downward into a horizontal position and unfolded.

It is a disadvantage of all known solutions that they can be mounted only on vertical surfaces of a building. The known emergency exits cannot be used in front of windows in oblique roof surfaces. A further disadvantage consists therein that these solutions use essentially the force of gravity, to move the emergency exit into the use position. The forces, which arise when the emergency exit is lowered, and the loads resulting from the persons to be rescued must be absorbed by holding elements fastened to a top of the building. This is associated with considerable uncertainties, since the holding elements themselves tear or can be pulled out of their anchorages.

SUMMARY OF THE INVENTION

It is an object of the present invention to provide a safety device for emergency exits, which lies essentially invisibly against the vertical or oblique outer surfaces of the building in the inoperative position and can be moved into an operation position in front of the emergency exit by means of simple manipulations.

Pursuant to the present invention, a safety device for an emergency exit which comprises a safety bracket, which is fastened pivotably to a building and, in an inoperative position, that is, when the emergency exit is not being used, lies below the emergency exit as close as possible to an outer surface of the building. In the case of danger, when the emergency exit is to be used, the safety bracket, which is easily accessible from the emergency exit, is raised and brought into an operative position. At the same time, the supports, pivotably mounted at the safety bracket, freely slide downward in a longitudinal direction of guide rails an pass a line perpendicular to the guide rails while pivoting in drag bearings of the supports and are supported at the lower end of the guide rails at a stop. In this position, the safety bracket, together with the supports in the guide rails, forms a solid, sturdy frame for a safety device outside of the respective building.

In another embodiment of the invention supports are mounted pivotably on a building and other ends of the supports are guided freely movably in a longitudinal direction of shanks of a safety bracket in such a manner that, in an inoperative position, the supports lie parallel to the ends of the shanks of the safety bracket. When the safety bracket is raised by the operator into an operative position, the supports, in a manner similar to that of claim 1, slide due to their weight or by forced means in the shanks as far as stops in the region in the comers of the safety bracket. In this position also, a sturdy safety device around the emergency exit is created. As a means essential to the invention, both variations of the solution have a safety net, which extends, at least, between the whole of the cross member of the safety bracket and the building. Whereas the safety bracket alone does not offer adequate safety, since persons, who use the emergency exit, can slide underneath the safety bracket, the safety net closes off the whole region of the emergency exit with great effectiveness. When the safety device is not in use, the safety net, folded together, preferably is in an appropriate receptacle at the surface of the building below the emergency exit.

Depending on the actual construction of the building, it is necessary that there is an adequate surface, on which the persons, who use the emergency exit, can stand within the safety bracket in the safety position. Such a surface can be one within the building itself. However, a separate surface may also be created which is disposed rigidly or pivotably on the building in such a manner that it lies against the building when the safety bracket is in the inoperative position and is pivoted away from the building into a horizontal operative position when the safety bracket is in the safety position.

When the inventive safety devices are used, the persons, who are in an emergency situation, can proceed with a high degree of safety to the emergency platform outside of the building and stay there. With that, it is ensured in a first step that the persons can be supplied with fresh air in a safe position. In the second step, the persons are fetched by helpers from the emergency exit or they can make their own way from there to the ground using known means, such as a rope ladder.

The invention has an important advantage in that the respective persons on the emergency exit are in a secure position from which they cannot fall. Compared to emergency rescues through windows or balcony balustrades, a significant increase in safety is achieved and the rescue is speeded up significantly.

The actual construction of the safety net depends, in particular, on the local conditions at the actual building. In every case, the possibility must exist that the persons below the fixed safety bracket pass through the region of the safety net. This can be, for example, a side, which is always free, or easily detachable connections can be present within the safety net and opened particularly by helpers, so that the persons can be freed through an opening in the safety net.

The invention can be improved further with additional distinguishing features. For example, it may be advantageous to equip the safety brackets with additional opening aids, so that raising in the case of danger is easily possible. In particular, such aids may be counterweights, mechanical springs or gas springs. Moreover, it is possible to equip the opening means of the emergency exit with forced mechanisms or with automatic means, so that, in every case when the emergency exit is opened, the safety device is moved automatically into the safety position.

Particularly on buildings, on which such safety devices are to be invisible, as far as possible, the safety device in the inoperative position can be disposed countersunk totally or partially in the surface of the building or it can be covered.

BRIEF DESCRIPTION OF THE DRAWINGS

Embodiments of the invention will be described in greater detail with reference to the figures wherein.

DETAILED DESCRIPTION OF THE PRESENT INVENTION

Figure 1:
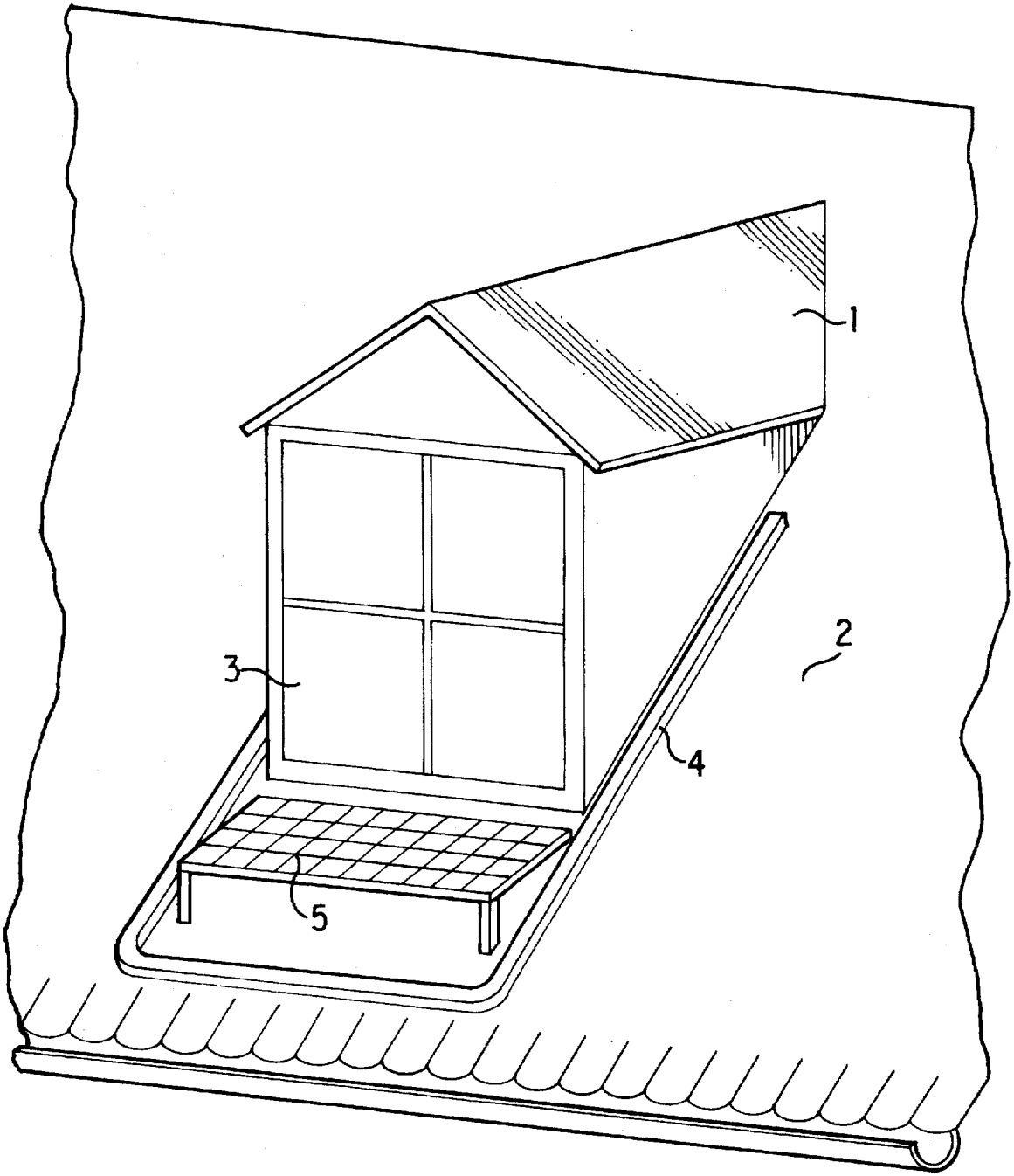
FIG. 1 shows a safety device in the inoperative position at a dormer.

In FIG. 1, a safety device is shown in an inoperative position at a dormer 1. The building is protected, for example, as a historical monument and the artistically valuable dormer 1 on the roof 2, the details of which are not shown here, is intended to be used as an emergency exit 3. At a height of about 20 to 40 meters, there is a safety device 4 for the safety of persons, who use the emergency exit. Due to its considerable distance from the ground, the safety device is essentially invisible in its inoperative position. Of the safety device as shown in FIG. 1, only the safety bracket 4 and the emergency platform 5 can be identified. Further aspects are described in greater detail in the following examples. FIG. 1 shows graphically that the inventive safety device can hardly be noticed visually when it is in its inoperative position.

Figure 2:
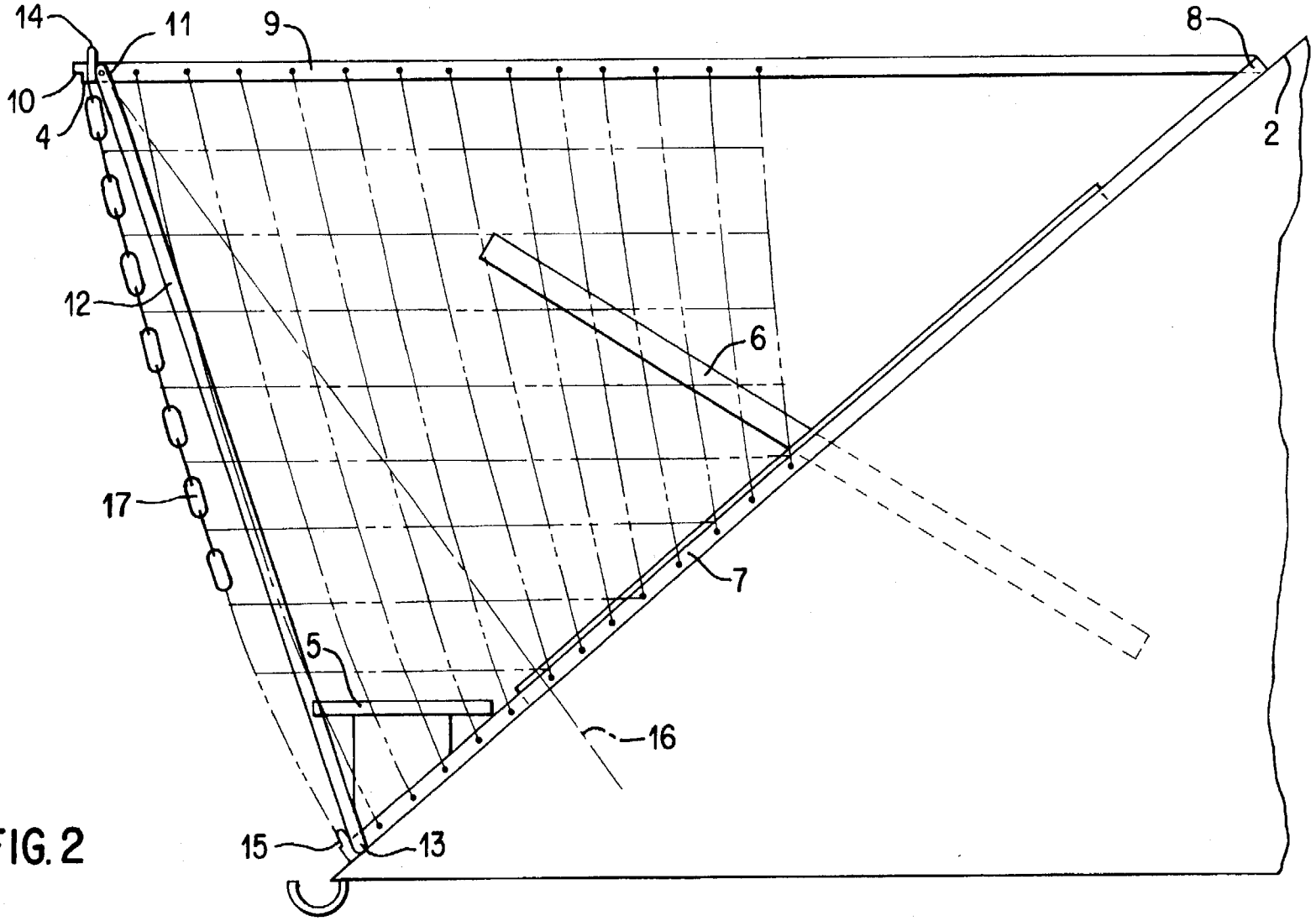
FIG. 2 shows a safety device in an operative safety position at an opened tilting roof window.

In FIG. 2, a tilting window 6, which is to be as an emergency exit, is shown in an oblique roof 2. For this purpose, there is an emergency platform 5 outside of the dormer 6. An inventive safety device is present for the protection of persons, who use the emergency platform 5. On either side of the tilting window 6, there is a guide rail 7, which is mounted firmly on the roof 2. At the upper end of the guide rail 7, there is a journal bearing 8, on which a shank 9 of the safety bracket 4 is mounted. With its two shanks 9, the safety bracket 4 encloses the whole width of the tilting roof window 6. In front of the tilting roof window 6 and the emergency platform 5, the safety bracket 4 is closed off by a transverse rod 10. A support 12 is pivotably disposed on each of the shanks 9 on both sides of the safety bracket 4 at the corners. The other end of each support 12 has a drive mechanism 13 in the form of a shiftable bearing or a sliding pad which is free to move in the longitudinal axis within the guide rail 7. In the inoperative position, the drive mechanism 13 of the supports 12 are parallel to the ends of the shanks 9. When the safety bracket 4 is raised at the handle 14, the drive mechanisms 13 freely roll downward within the guide rail 7 up to a stop 15. This stop 15 is below the line 16, which is perpendicular to the guide rail 7 at the drag bearing 11. In this position, the safety bracket 4 is supported stably on the supports 12 and forms a secure frame around the whole of the emergency exit. In addition, it may be advantageous if the guide rails 7 are spread out slightly towards the bottom. With this arrangement the supports 12 are also placed slightly obliquely towards the outside and the stability of the safety device is increased further. Between the safety bracket 4, consisting of the two shanks 9 as well as the transverse rod 10, and the surface of the roof 2, a safety net 17 is disposed which surrounds the emergency platform 5. In the inoperative position, the safety net 17 is folded together in an appropriate trough-like container; the details of which are not shown in the drawing. It has proven to be advantageous if the safety net is constructed from steel chains, which are connected crosswise.

Several net crosses of the safety net are connected together with an easily detachable connecting bolt approximately in the center of the transverse rod 10. Moreover, springs, the details of which are not shown in the drawing and which equalize the weight of the safety device and, with that, facilitate raising the safety bracket 4 in an emergency, are disposed in the region of the drag bearing 8.

In the inoperative position of the safety device, the shanks of the safety brackets 4 are parallel to the guide rails 7, close to the surface of the roof 2, and are not an annoyance visually in any way. In an emergency, when persons are in danger, the tilting roof window 6 is opened and the safety bracket 4 is pulled up. At the same time, the basket-like safety device is installed immediately in front of the emergency exit. With this, the endangered persons in a first step are in a position to leave the inner room of the building for the outside. In a second step, the safe rescue of the persons from the safety device by the emergency workers, particularly the firemen, becomes possible. In the meantime, there is no danger that the persons on the emergency platform 5 on the oblique roof 2 will fall off. For the subsequent rescues, it is not necessary to overcome any windows, parapets or the like and it is possible to step on the emergency platform safely. To rescue the persons, the connecting bolt in the front part of the safety net 17 is opened by the emergency workers and the persons, who are in an emergency situation, can leave the emergency platform safely corresponding to the circumstances.

Figure 3:
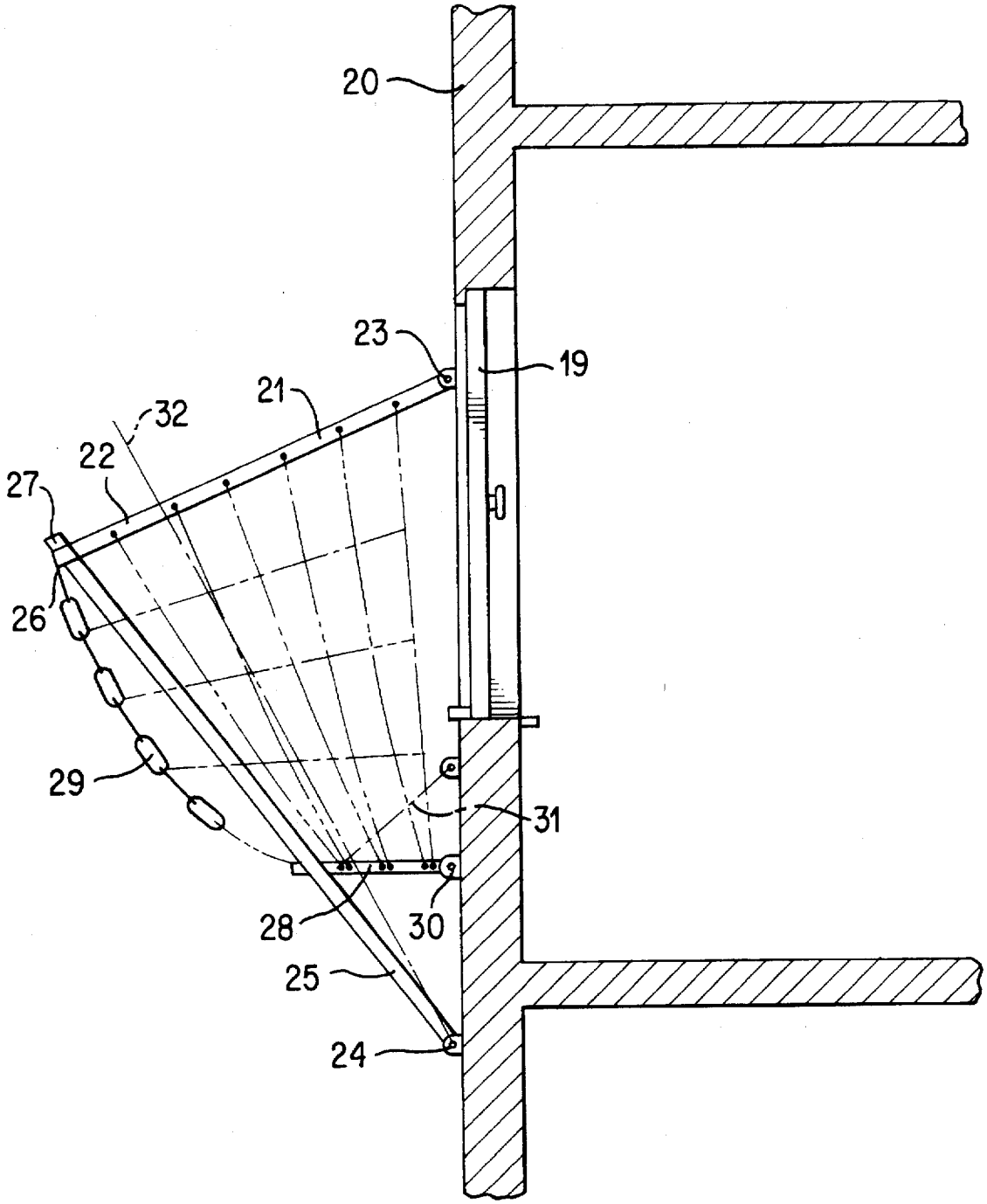
FIG. 3 shows a safety device in the operative safety position on a vertical wall of a house.

In FIG. 3, an inventive safety device at a vertical wall of a house is shown. Such safety devices can be installed subsequently in older multistory buildings, so that the latter will comply with newer safety regulations.

In the example, the safety device is mounted in front of a window 19 at a wall 20 of a house. In case of an emergency, the window 19 is intended to function simultaneously as an emergency exit. The safety device has a safety bracket 21, two shanks 22 of which are pivotably mounted in two journal bearings 23 at wall 20 of the house. Supports 25, each of which is pivotably mounted in a journal bearing 24, are in the vertical plane of the shanks 22 of the safety bracket 21 below the window 19. The upper ends of the supports 25, opposite the journal bearings 24, are equipped with a sliding pad 26 which can be shifted freely in the longitudinal direction within the shank 22. There are suitable stops for the sliding pads in the corner regions of the safety bracket. Between the crossbar 27 of the safety bracket 21 and a front edge of an emergency platform 28, there is a safety net 29. The emergency platform 28 is pivotably mounted an journal bearings 30 at the wall 20 of the house and secured over two lateral holding chains 31.

In the inoperative position, all parts of the safety device, the emergency platform 28, the supports 25 and the safety bracket 21 including the safety net 29, are placed against the wall of the house. In this connection, the safety bracket 21 is constructed so that it does not cover the window 19, that is, so that the view from the window is not affected. The safety device can also be disposed countersunk within the brickwork of the wall 20 of the house in such a way, that the safety device in the inoperative position is largely invisible.

In an emergency, the window 19 is opened and the crossbar 27 of the safety bracket 21, which is easily accessible and lies below the window opening, is pushed forward and upward. At the same time, the supports 25 pivot on journal bearings in the shanks 22 and slide down towards the outside up to a stop below the line 32 which is perpendicular to the legs 22 at the drag bearing 24 and support the safety bracket 21. At the same time, the emergency platform 28 falls towards the outside until the holding chains 31 are taut. With the lifting of the safety bracket 21, the safety net 29 is also unfolded and the emergency platform 28 can be stepped on immediately after the safety device is swung out. The persons in danger can be rescued as described in the preceding example.

I claim:

1. A safety device for an emergency exit window on a surface of a building which is extendable from a substantially flat inoperative position to an extended operative position, the safety device comprising:

a safety bracket having shanks with first ends connected by a cross member and second ends having means for pivotally attaching to said surface of said building such that when said safety bracket is in the inoperative position the shanks are parallel to the surface of the building on either side of the window and such that said cross member is below said window and such that when said safety bracket is pivoted to the operative position said shanks extend approximately horizontally in front of the window and said cross member is positioned in front of said window;

a support member having a first end pivotably disposed on at least one of said shanks of the safety bracket;

a guide rail anchorable on the building essentially parallel to the inoperative position of said at least one of the shanks and having a slidable bearing means for slidably and pivotally supporting a second end of said support member such that said guide rail, said at least one of said shanks and said support member lie parallel when said safety device is in said inoperative position;

said slidable bearing means being free to slide along a longitudinal axis of the guide rail when said safety bracket is extended from said inoperative position to said operative position, and said guide rail having a stop mounted at a lower end of the guide rail at a position for stopping said slidable bearing means such that said support member pivots through a angle greater than 90° relative to said at least one of said shanks when said safety device is extended from said inoperative position to said operative position to stably support said safety bracket; and a safety net connected to the cross member of the safety bracket and attachable to the surface of the building to enclose an area for accepting persons when said safety device is in said operative position.

2. The safety device of claim 1, wherein the means for pivotally attaching said second ends of the shanks of the safety bracket to said surface of the building include means for pivotally attaching said second ends to upper ends of the guide rails.

3. A safety device for an emergency exit on a surface of a building which is extendable from a substantially flat inoperative position to an extended operative position, the safety device comprising:

a safety bracket having shanks with first ends connected by a cross member and second ends having means for pivotally attaching to said surface of said building such that when said safety bracket is in the inoperative position the shanks lie parallel to the surface of the building on either side next to the window and said cross member is below said window and such that when said safety bracket is pivoted to the operative position said shanks extend approximately horizontally in front of the window and said cross member is positioned in front of said window.

a support member having a first end pivotally connected to slidable bearing means free to shift along a longitudinal axis of one of said shanks and a second end pivotably mountable on the surface of the building such that the support member is essentially parallel to said one of said shanks of the safety bracket when said safety device is in the inoperative position, and said one of said shanks having a stop at a position for stopping said sliclable bearing such that said support member pivots through a angle greater than 90° relative to said at least one of said shanks when said safety device is extended from said inoperative position to said operative position to stably support said safety bracket; and a safety net connected to the cross member of the safety bracket and attachable to the surface of the building to enclose an area for accepting persons when said safety device is in said operative position.

4. The safety device of claims 1 or 3, further comprising an emergency platform disposable within a pivoting range of the safety bracket for a person to step onto when exiting from the emergency exit.

5. The safety device of claim 4, wherein the emergency platform is permanently disposed on the building.

6. The safety device of claim 4 wherein the emergency platform is pivotably disposed on the building such that the emergency platform lies against the surface of the building when said safety bracket is in the inoperative position and is pivoted away from the surface of the building into a horizontal use position when the safety bracket is in the operative position.

7. The safety device of claims 1 or 3, wherein said slidable bearing means is in the form of a sliding pad.

8. The safety device of claims 1 or 3, wherein the safety bracket has at least one handle for raising the safety bracket.

9. The safety device of claims 1 or 3, wherein the safety net is formed of chain links.

10. The safety device of claims 1 and 2, wherein the safety net is detachably disposed so that persons through an area covered by the safety net.

11. A safety device for an emergency exit window on a surface of a building which is extendable from a substantially flat inoperative position to an extended operative position, the safety device comprising:

a safety bracket having side members with first ends connected by a cross member and second ends having means for pivotally attaching to said surface of said building such that when said safety bracket is in the inoperative position the safety bracket lies adjacent the surface of the building with the side members parallel to the surface of the building on either side of the window and said cross member below said window and such that when said safety bracket is pivoted to the operative position said side members extend approximately horizontally and said cross member is positioned in front of said window;

said side members each having a support member having a first end pivotably disposed on said side members of the safety bracket and a second end pivotally connectable to the surface of said building;

guide rails anchorable on the building essentially parallel to the inoperative position of said side members and having a slidable bearing means for slidably and pivotally supporting said second ends of said support members such that said guide rail, said side members and said support members lie parallel when said safety device is in said inoperative position;

said slidable bearing means being free to slide along a longitudinal axis of the guide rails when said safety bracket is extended from said inoperative position to said operative position, and said guide rails having a stop mounted at lower ends of the guide rails at a position for stopping said slidable bearing means such that said support members pivot through a angle greater than 90° relative to respective ones of said side members when said safety device is extended from said inoperative position to said operative position to stably support said safety bracket; and a safety net connected to the cross member of the safety bracket and attachable to the surface of the building to enclose an area for accepting persons when said safety device is in said operative position.

12. A safety device for an emergency exit window on a surface of a building which is extendable from a substantially flat inoperative position to an extended operative position, the safety device comprising:

a safety bracket having side members with first ends connected by a cross member and second ends having means for pivotally attaching to said surface of said building such that when said safety bracket is in the inoperative position the safety bracket lies adjacent the surface of the building with the side members parallel to the surface of the building on either side of the window and said cross member below said window and such that when said safety bracket is pivoted to the operative position said side members extend approximately horizontally and said cross member is positioned in front of said window;

said side members each having a support member;

said support members having a first end pivotably disposed on said side members of the safety bracket and a second end pivotably connectable to the surface of said building;

slidable bearing means for supporting one of said first and second ends of said support members such that said side members and said support members lie parallel when said safety device is in said inoperative position and when said safety bracket is extended from said inoperative position to said operative position said support members pivot through a angle greater than 90° relative to respective ones of said side members to stably support said safety bracket; and a safety net connected to the cross member of the safety bracket and attachable to the surface of the building to enclose an area for accepting persons when said safety device is in said operative position.

* * * * *